US007000868B1

(12) United States Patent
Moore et al.

(10) Patent No.: US 7,000,868 B1
(45) Date of Patent: Feb. 21, 2006

(54) THREAD STORAGE AND DISPENSING APPARATUS

(76) Inventors: Eddy C. Moore, c/o Sewing Center Supply 9631 NE. Colfax St., Portland, OR (US) 97220; Michael T. Schmidt, Immentalstrasse 21, 79104 Freiburg (DE)

( * ) Notice: Subject to any disclaimer, the term of this patent is extended or adjusted under 35 U.S.C. 154(b) by 0 days.

(21) Appl. No.: 10/776,924

(22) Filed: Feb. 10, 2004

Related U.S. Application Data

(60) Provisional application No. 60/450,739, filed on Feb. 28, 2003.

(51) Int. Cl.
*B65H 49/00* (2006.01)
*B65H 57/04* (2006.01)
*B65H 57/18* (2006.01)

(52) U.S. Cl. ..... 242/588.2; 242/137.1; 242/140; 242/594.4; 206/409; 112/302; 112/254

(58) Field of Classification Search ..... 312/208.5, 312/208.6
See application file for complete search history.

(56) References Cited

U.S. PATENT DOCUMENTS 2,588,540 A * 3/1952 Koistinen ..... 225/38
4,036,418 A * 7/1977 Chlebda ..... 206/391
5,139,160 A * 8/1992 Romano ..... 211/44
5,842,655 A * 12/1998 McCarthy ..... 242/129
6,513,742 B1 * 2/2003 Watson ..... 242/171
6,776,283 B1 * 8/2004 Drexler ..... 206/391

OTHER PUBLICATIONS

JK Quilting, Sulky Thread Slimeline Storage Box, Item #7000-885, www.jkquilting.com, Dec. 20, 2002.
#LLB @Box, Lulu's Little Box Carryall, Little Foot, Ltd., Checker Distributors Sale Flyer, Sep.-Nov. 2002.
Advertising flyer for Maderia thread spool box and sampler box, undated, SCS-USA, Portland, Oregon.

* cited by examiner

*Primary Examiner*—Kathy Matecki
*Assistant Examiner*—William E. Dondero
(74) *Attorney, Agent, or Firm*—Marger Johnson & McCollom, P.C.

(57) ABSTRACT

A multiple thread dispenser which serves as both a portable container for many spools of thread and a dispenser of multiple strands of thread. The container dispenses thread for use with a sewing machine. The spools of thread are stored in an array of pockets which are relieved for easy access to the spools. Multiple strands of thread dispense from a top row of pockets. A base plate stabilizes the container while dispensing thread to a sewing machine. The base plate can be stored within the container during transport. The base plate has a pocket on the bottom of the base plate for printed material that can be viewed through a semi-transparent lid when the base plate is in its stored position.

16 Claims, 9 Drawing Sheets

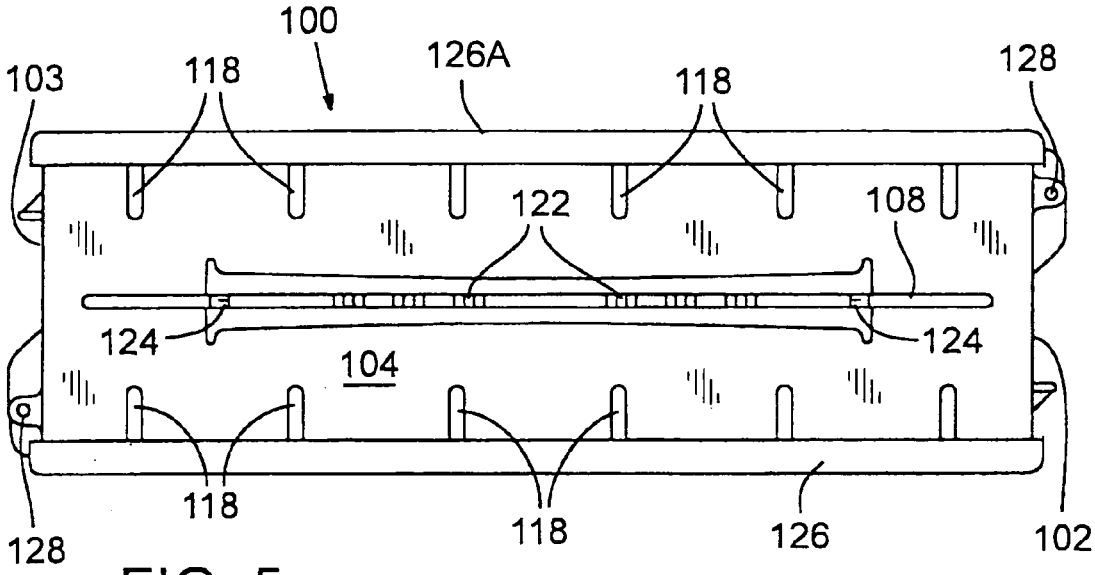
FIG. 5
FIG. 6
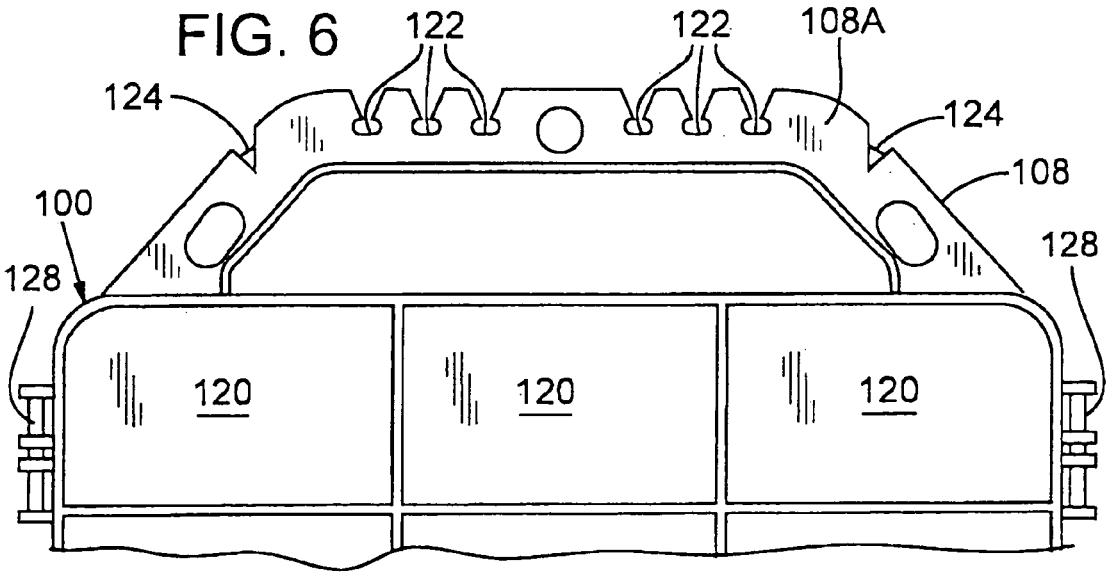

THREAD STORAGE AND DISPENSING APPARATUS

RELATED APPLICATION DATA

This application claims priority from U.S. Provisional Application Ser. No. 60/450,739; filed Feb. 28, 2003.

BACKGROUND OF THE INVENTION

The coupling of computer technology and sewing machines allows ordinary consumers to produce complex embroidery at home that was once only available from commercial sewing machines. This marriage of sewing and computers created a dedicated following centered around home embroidery. Ordinary consumers can now buy or download digitized designs that only professionals were once able to produce.

While the industrial sewing equipment simultaneously utilizes multiple needles and threads, the new computerized home sewing machines remain restricted to a single needle using just one strand of thread at any one time. To make multi-colored embroidery, an ordinary consumer must sew with one color of thread, clip that thread, and then use the next color of thread, repeating this process until finished. Switching threads involves handling, arranging and organizing multiple spools of thread.

The tradition of the sewing circle embraces these new computer-enhanced sewing machines. The participants of the new sewing circles now bring their modern, computer-equipped embroidery machines along with multiple spools of thread. At the sewing circle, the participants must deal with the same issues of changing threads but must also deal with transporting and keeping their finely colored threads organized.

A multiple thread dispenser would help the ordinary consumer efficiently deal with switching from thread to thread while sewing complex embroidery patterns. Also, it would be helpful to the ordinary consumer if the thread organizing and dispensing device performed the task of conveniently transporting the spools of thread.

SUMMARY OF THE INVENTION

It is an object of the invention to provide a multiple thread dispenser which serves both as a portable container for many spools of thread and as a dispenser of multiple strands of thread from spools in the container directly to a sewing machine. The dispenser comprises a storage container for multiple spools of thread which also acts as a dispenser of multiple spools of thread wherein the multiple spools of thread are stored in an array of pockets in a container and strands of thread are dispensed from multiple spools residing in a top row of pockets. The strands of thread are dispensed by each passing through a separate first slot located on the outer wall adjacent to the top row of pockets then by each passing through a separate second slot. A second slot tensions the thread to prevent the thread from tangling while feeding into a sewing machine. The array of second slots is most conveniently positioned on a handle but the array of second slots can be positioned on a mere protrusion for supporting the array of second slots. A first strand of thread can then be fed into a sewing machine with the other strands of thread available for switching with the first strand of thread in the sewing machine.

It is also an object of the invention to supply a stabilizing means for the container while the thread is being dispensed.

The stabilizing means is a base plate that is temporarily attachable to the bottom of the container. It is another object of the invention to allow the base plate to be stored within the container and for a pocket to be formed on the bottom of the base plate to allow for storage of printed materials that can be displayed through a semi-transparent lid on the container when the base plate is in a stored position.

The foregoing and other objects, features and advantages will become more apparent from the detailed description of a preferred embodiment, which proceeds with reference to the drawings.

BRIEF DESCRIPTION OF THE DRAWINGS

FIG. 5 is a top view of the thread dispenser of FIG. 1.

FIG. 6 is a detailed elevation view of the handle on the thread dispenser of FIG. 1.

DETAILED DESCRIPTION

Figure 1:
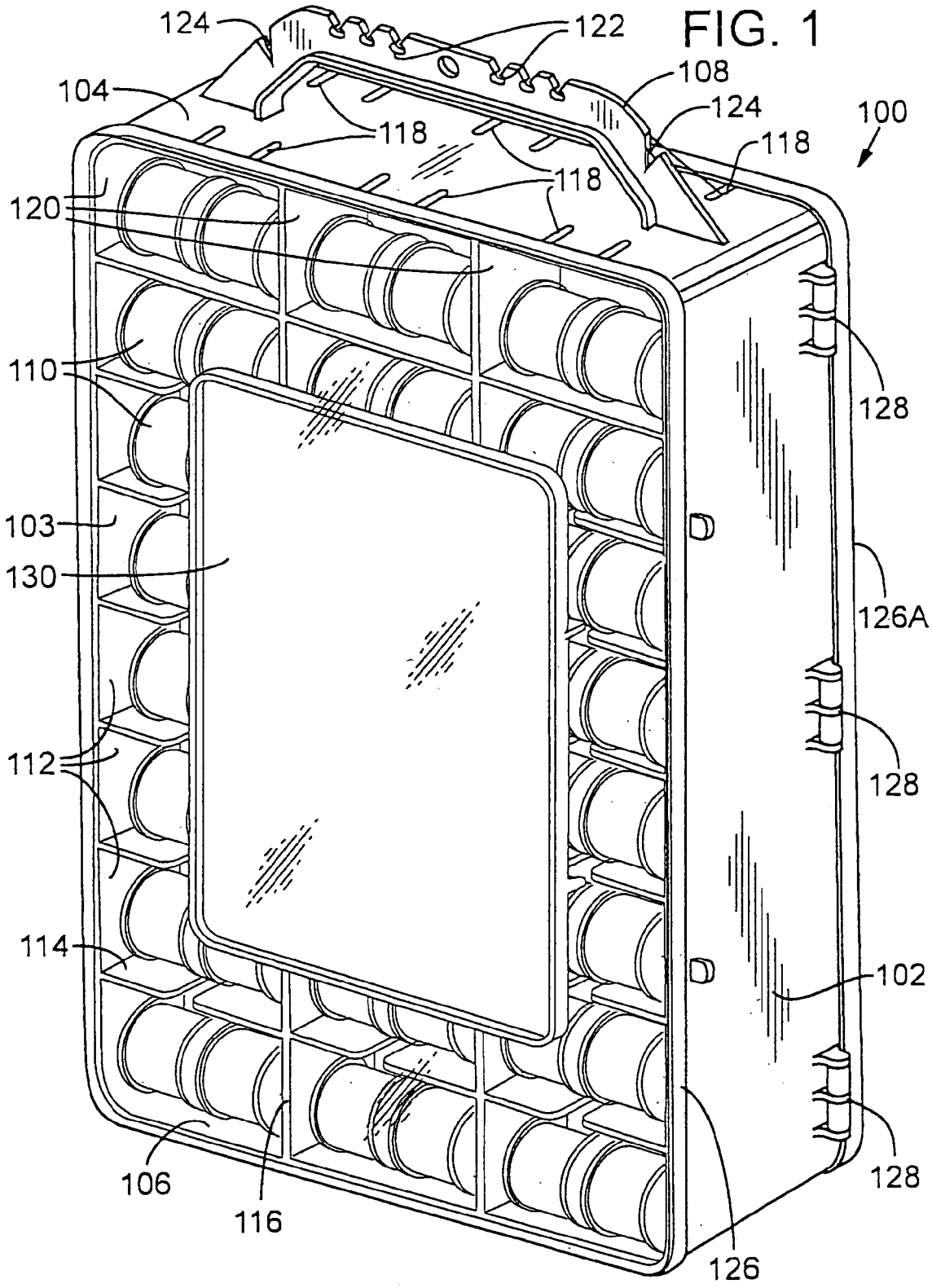
FIG. 1 is a perspective view of the preferred embodiment of the thread dispenser showing the semi-transparent lid closed and the base plate stored in the container.

FIG. 1 shows a perspective view of the preferred embodiment of the thread dispenser. The dispenser is a container 100 made up of side walls 102 and 103 and top and bottom walls 104 and 106, with a handle 108 located on the top wall 104. The spools of thread 110 reside in the array of pockets 112, which is defined by horizontal and vertical partitions, 114 and 116, respectively. A first array of slots 118 is located on the top wall 104 for dispensing thread from the top row of pockets 120. A second array of slots 122 for tensioning the dispensed thread is located on the handle 108. Thread cutters 124 are also located on the handle 108. A semi-transparent lid, 126, forming a front wall of the container 100 is shown in the closed position. This view also shows hinges 128 for the lid 126A forming the front wall of a second layer of pockets 112A on the opposite side of the container. The base plate 130 is shown stored in the container 100.

Figure 2:
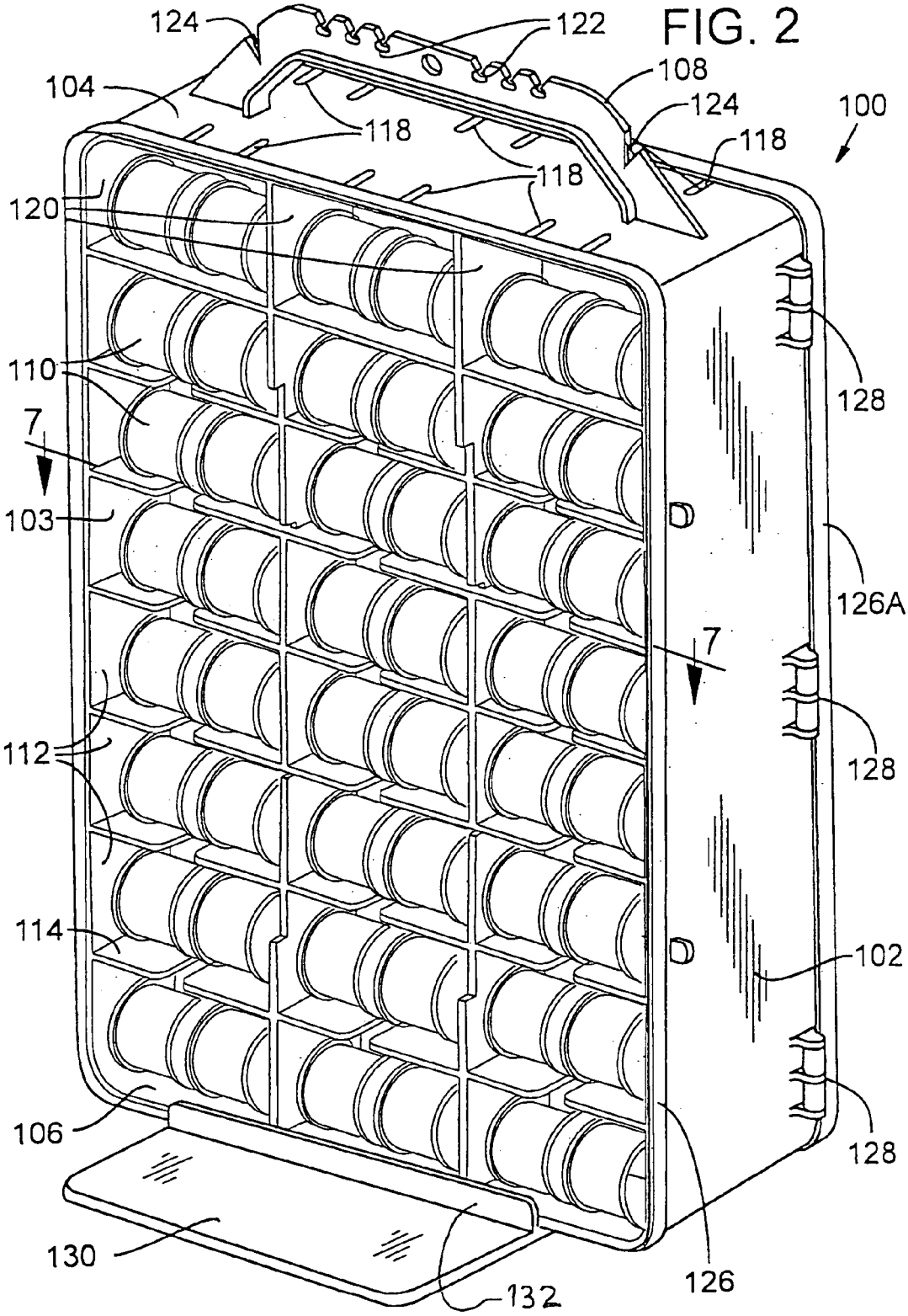
FIG. 2 is a perspective view of the thread dispenser of FIG. 1 with the semi-transparent lid closed and the dispenser placed on the base plate.
Figure 2A:
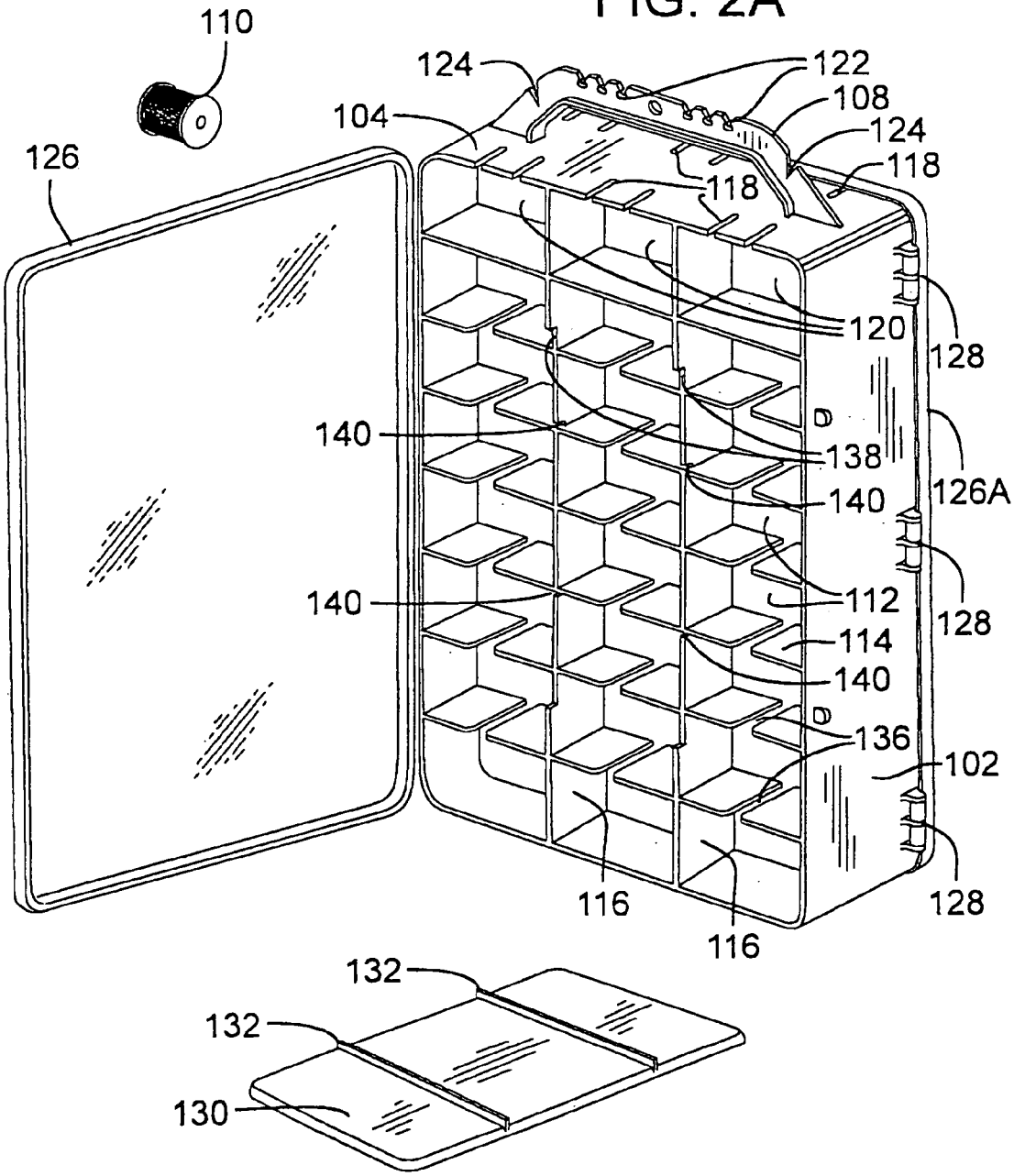
FIG. 2A is an exploded perspective view of the thread dispenser of FIG. 1 and the base plate.

FIG. 2 shows the thread dispenser sitting on the base plate 130 with ridges 132 of the base plate fitting snugly against the outside of the lid 126. FIG. 2A shows the thread dispenser of FIG. 2 in an exploded view with the lid 126 in an open position and the array of pockets 112 empty. The base plate 130 has two ridges 132 that the dispenser fits between when the dispenser is mounted on the base plate 130. FIG. 2A also shows the top row of pockets 120 adjacent to the top wall 104. This view also shows the reliefs 136 formed in the horizontal partitions 114 below the top row of pockets 120. Also shown are reliefs 138 and 140 in the vertical partitions 116 for storage of the base plate 130 under lid 126.

Figure 3:
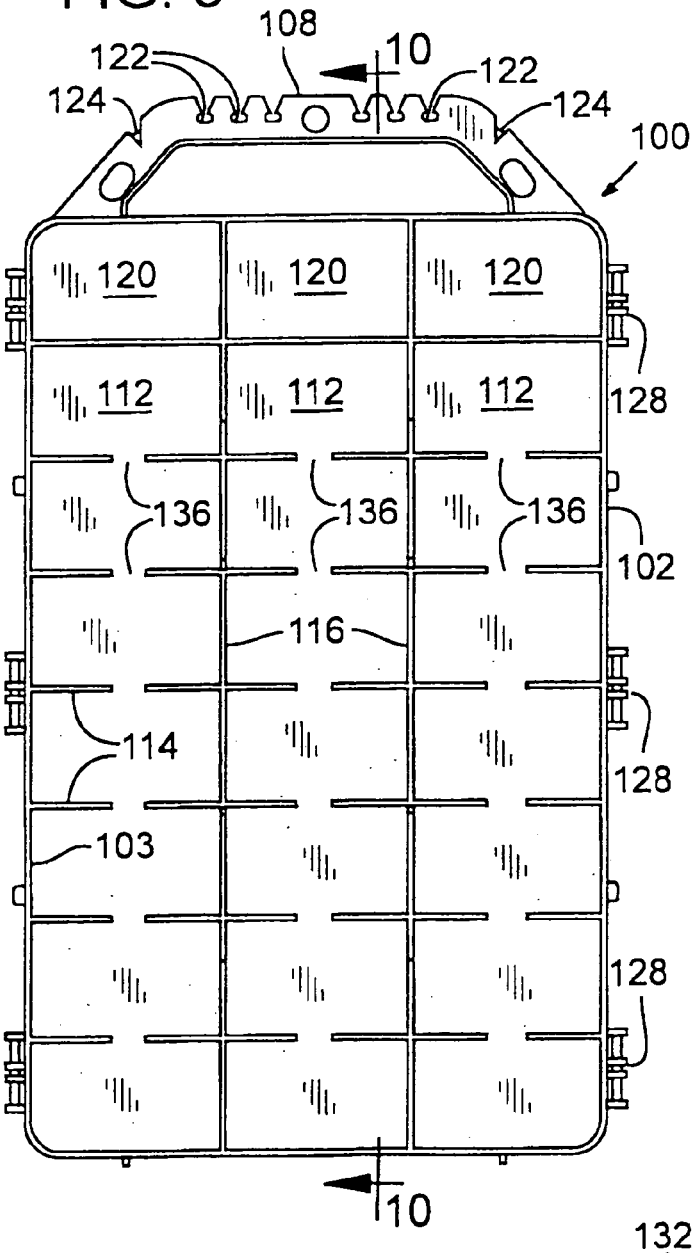
FIG. 3 is an elevation view of the thread dispenser of FIG. 1 without the lid.

FIG. 3 is an elevation view of the thread dispenser of FIG. 1 without lid 126. This view shows the pockets 112 formed by the horizontal and vertical partitions 114 and 116, the handle 108, the second array of slots 122 in the handle and the thread cutters 124 in the handle.

Figure 4:
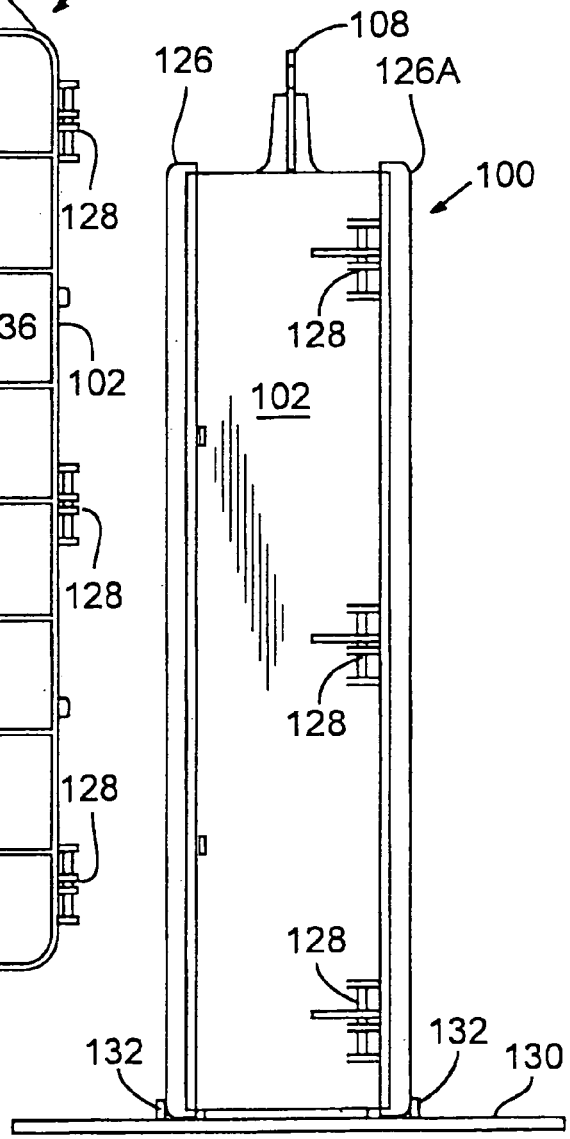
FIG. 4 is a side view of the thread dispenser as shown in FIG. 2.

FIG. 4 is a side view of the thread dispenser of FIG. 1 shown sitting on the base plate 130. The container 100 with closed lids 126 and 126A fits snugly between the ridges 132 of the base plate 130 with the base plate extending out for stabilizing the thread dispenser during use with a sewing machine.

FIG. 5 is a top view of the thread dispenser of FIG. 1 showing the lids 126 and 126A closed which closes the first array of slots 118 along opposite edges of the top wall 104 of the container 100. This view also shows the handle 108 centered in the top wall and the hinges 128 for the lids 126 and 126A mounted diagonally opposite edges of side walls 103, 102.

FIG. 6 is a detailed elevation view of the thread dispenser of FIG. 1 showing the handle 108 and the second array of slots 122 used for tensioning the thread dispensing from the container 100. The handle is formed with an inverted T-shaped cross-section and second array of slots 122 formed in the central flange, 108A, of the mid-portion of the handle. Also shown are the thread cutters 124 on the end portions of the handle 108.

Figure 7:
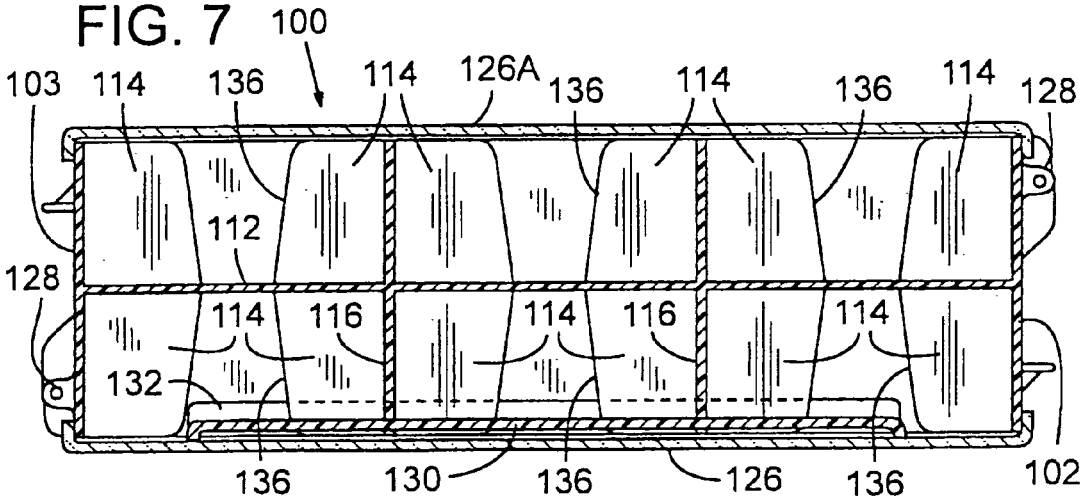
FIG. 7 is a cross-section view of the thread dispenser of FIG. 1 taken along line 7—7 in FIG. 2 showing the finger access reliefs in the horizontal partitions.

FIG. 7 is a cross-section view of the thread dispenser of FIG. 1 taken along line 7—7 of FIG. 2. Reliefs 136 in the horizontal partitions 114 provide easy access by fingers to retrieve spools of thread from the pockets.

Figure 8:
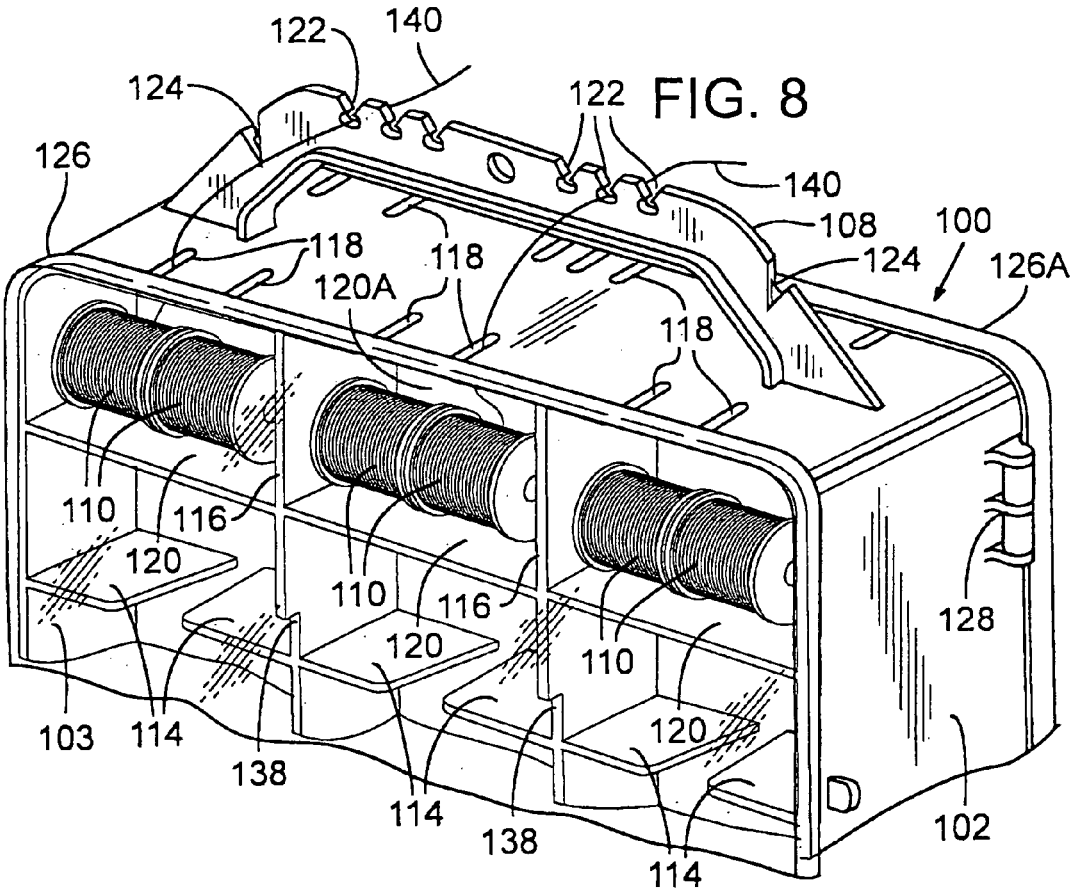
FIG. 8 is a detailed perspective view of the top portion of the thread dispenser of FIG. 2A showing thread dispensing from a spool residing in the container.

FIG. 8 is a detailed perspective view of thread dispensing from the thread dispenser of FIG. 1. The thread 140 unwinds off of spools 110 residing in top pockets 120A. The thread dispenses through first slot 118, being captured in that slot by lid 126. The thread 140 is tensioned by the second slot 122 located in handle 108.

Figure 9:
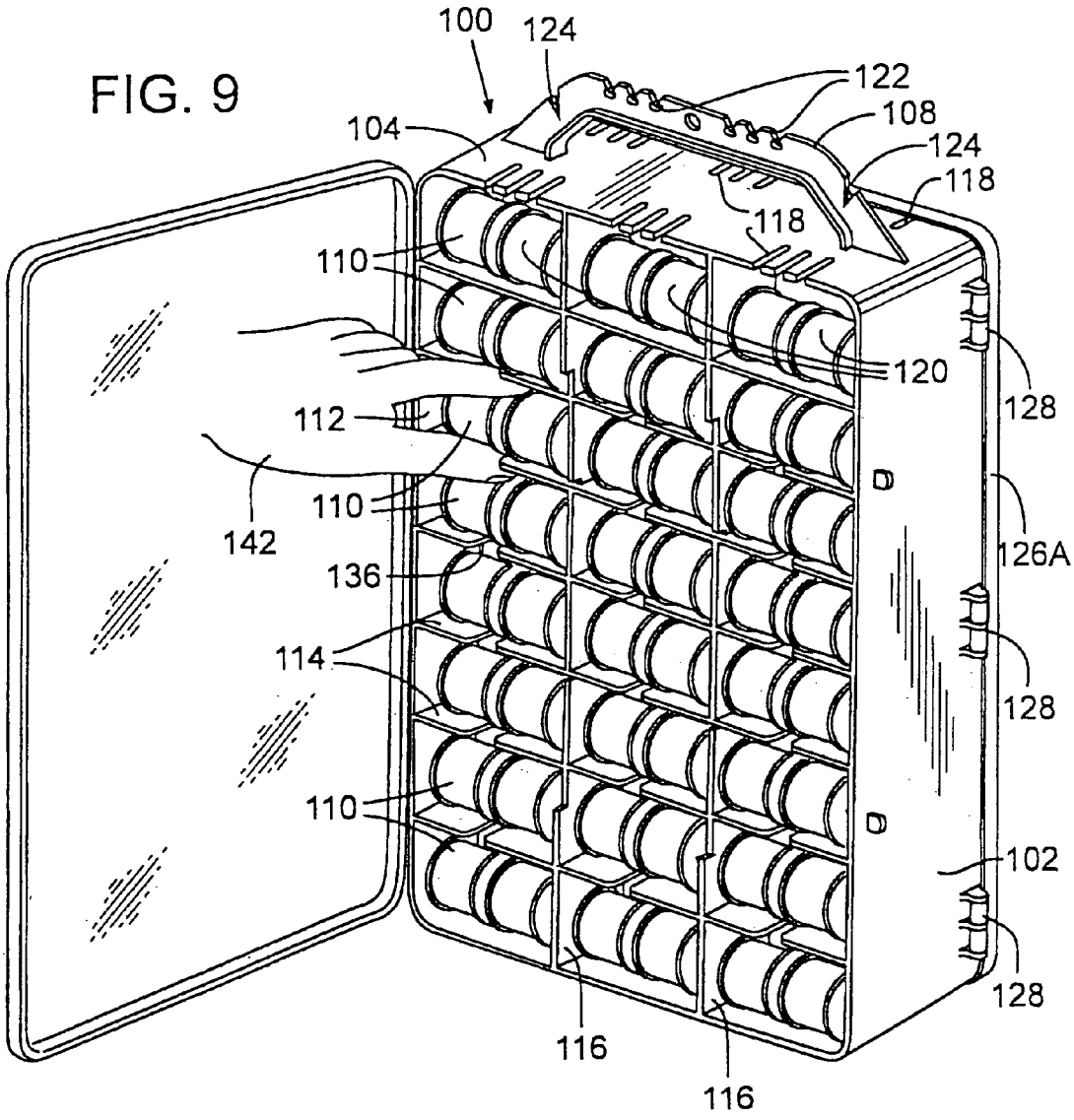
FIG. 9 is a detailed perspective view of a person retrieving a spool from a pocket of the thread dispenser of FIG. 1.

FIG. 9 shows a perspective view of the thread dispenser of FIG. 1 showing a person's hand 142 retrieving a spool of thread 110 from pocket 112 utilizing the reliefs 136 formed in the horizontal partitions 114.

Figure 10:
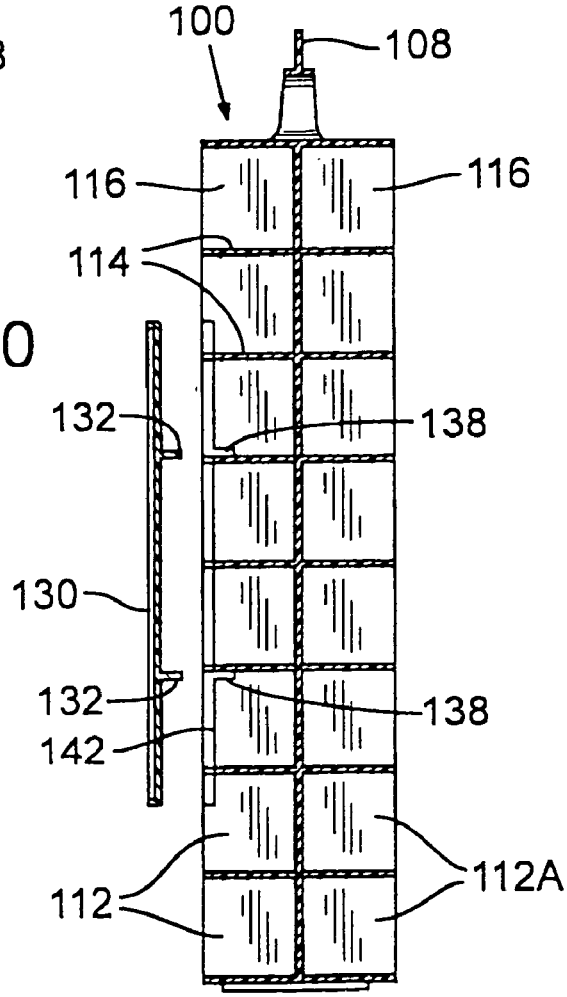
FIG. 10 is a cross-section view of the thread dispenser of FIG. 1 taken along line 10—10 in FIG. 3 showing the base plate stored in the relief formed into the pocket walls.

FIG. 10 is an exploded cross-section view of the thread dispenser of FIG. 1 taken along line 10—10 in FIG. 3 showing the horizontal and vertical partitions 114 and 116 of the first and second layers of pockets 112 and 112A and the base plate 130. The dispenser, the spacing of the pockets 112 and the ridges 132 on base plate 130 are sized so that the base plate 130 fits snugly in the container 100 with the ridges 132 fitting against the horizontal partitions 114. Reliefs 138 and 140 are formed in the vertical partitions 116 to allow the base plate 130 to fit fully inside the container 100 with the lid 126 closed.

Figure 11:
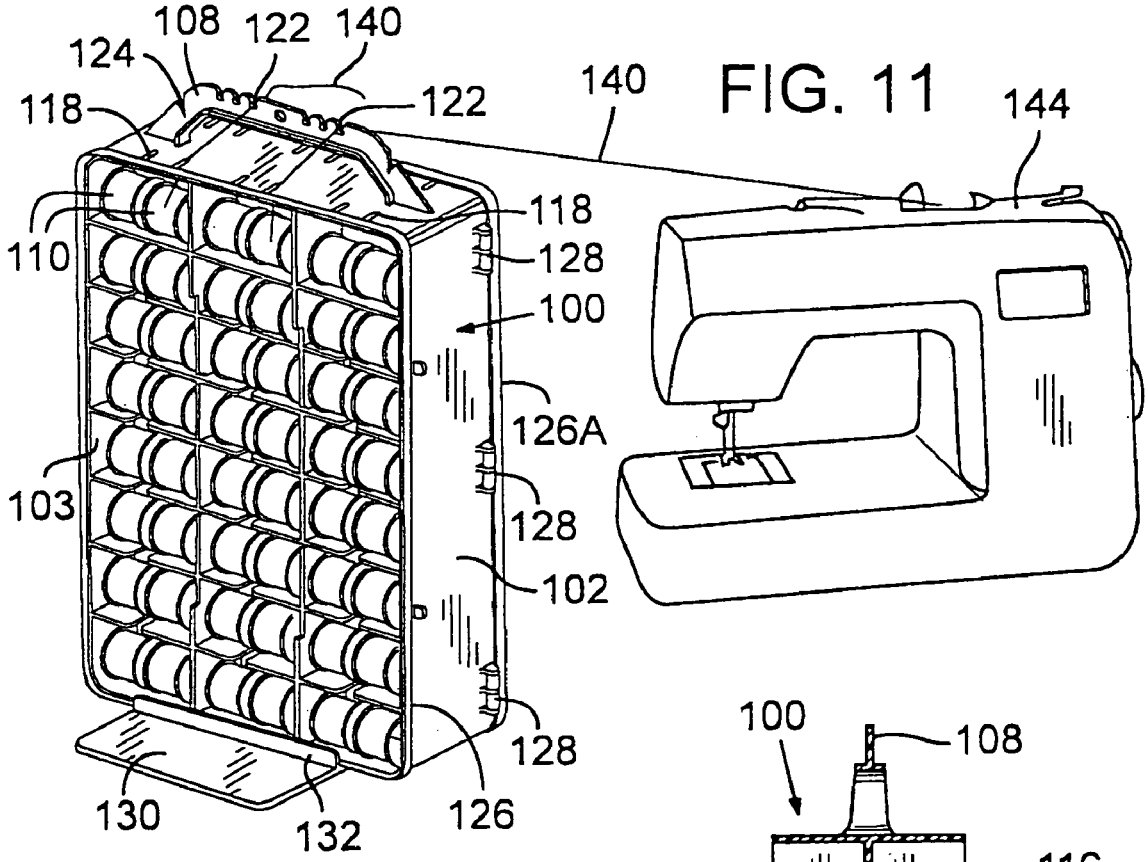
FIG. 11 is a perspective view of the preferred embodiment of the thread dispenser of FIG. 1 showing thread dispensing from the container to a sewing machine.

FIG. 11 shows the thread dispenser of FIG. 1 showing thread 140 dispensing through the first slot 118, being tensioned by the second slot 122, and feeding into a sewing machine 144. The thread dispenser is stabilized during use by the base plate 130.

Figure 12A:
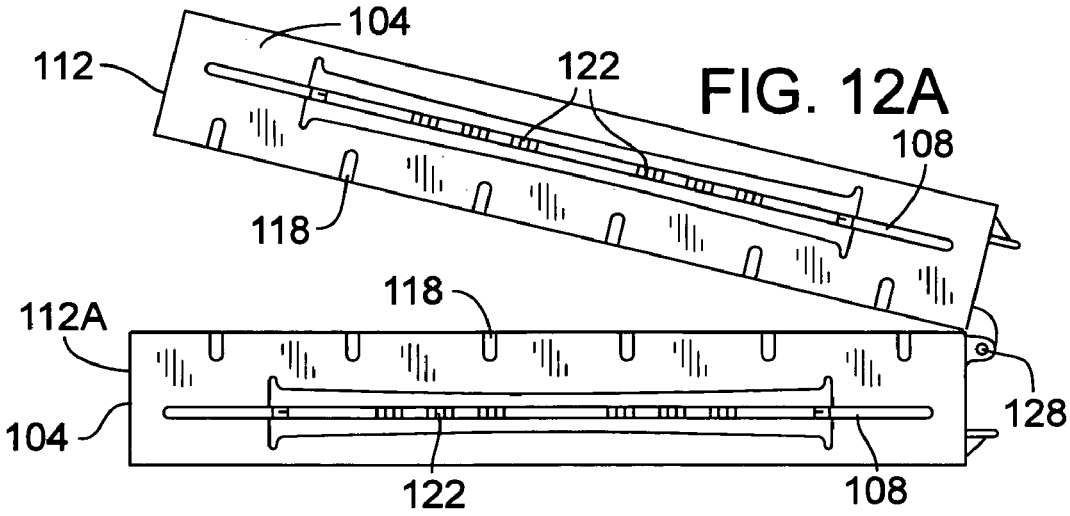
FIG. 12A is a top view of a "clam-shell" embodiment of the thread dispenser of FIG. 1.
Figure 12B:
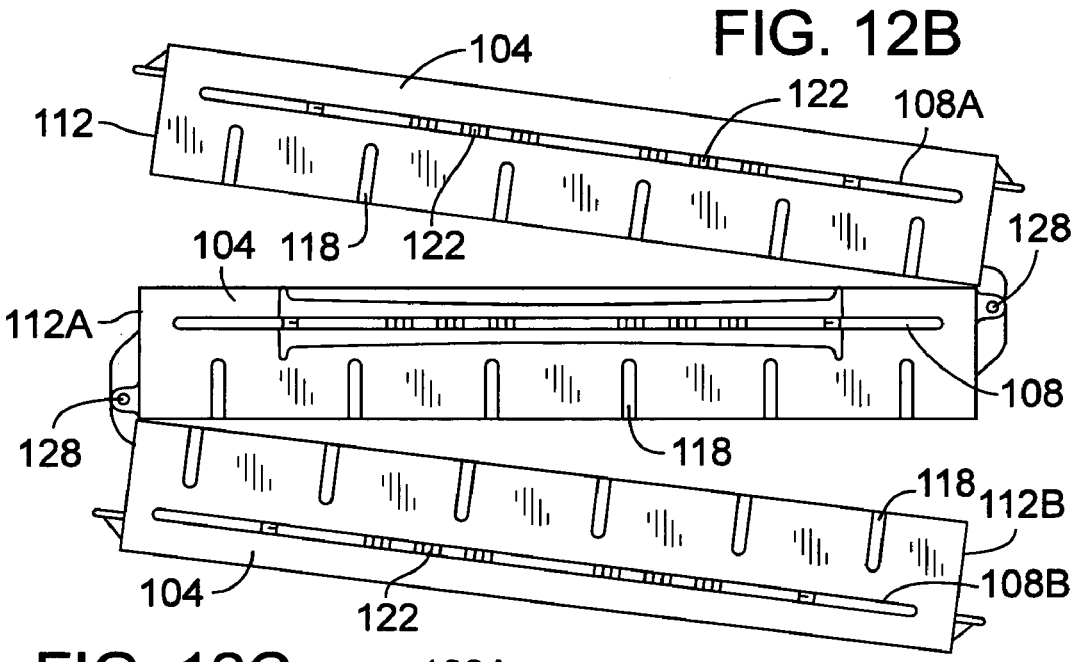
FIG. 12B is a top view of a "tri-fold" embodiment of the thread dispenser of FIG. 1.
Figure 12C:
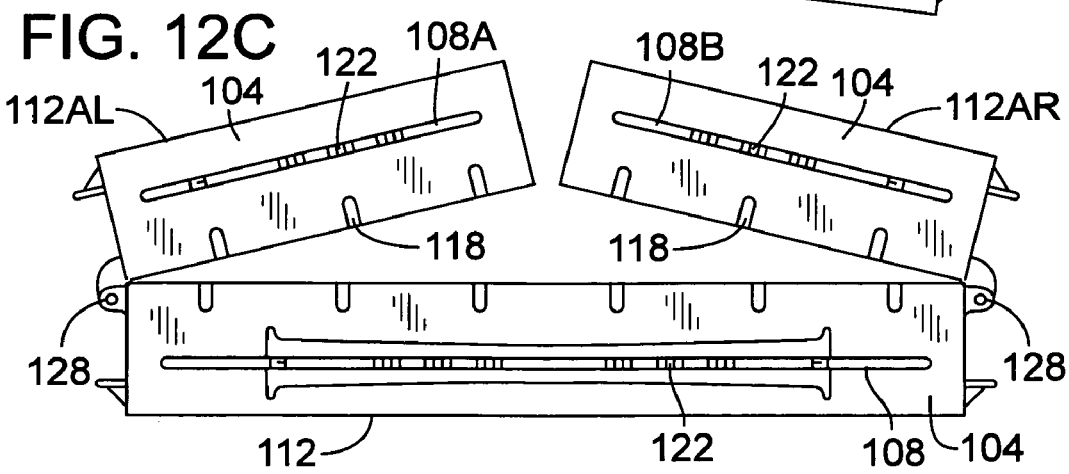
FIG. 12C is a top view of yet another embodiment of the thread dispenser of FIG. 1.

FIG. 12A shows a top view of another possible embodiment of the thread dispenser of FIG. 1. This "clam-shell" embodiment has a first and second layer of pockets, 112 and 112A, stacked with center hinges 128 located on one side of the dispenser. The first array of slots 118 is located on the top wall 104 of each layer and can be staggered along the top wall. FIG. 12B shows a top view of a "tri-fold" embodiment of the thread dispenser of FIG. 1. The "tri-fold" embodiment has three layers of pockets, 112, 112A and 112B, stacked with the first array of slots 118 located on the top wall 104 of each layer of pockets and a handle 108 in layer 112A, and flanges 108A, 108B in layers 112, 112B. FIG. 12C shows a top view of another possible embodiment of the thread dispenser of FIG. 1 defined by two stacked layers of pockets 112 and 112A. The second layer of pockets 112A is separated into two halves 112AL and 112AR, which open up by means of hinges 128. The first array of slots 118 is located on the top wall 104 of each layer of pockets. Handle 108 is formed atop layer 112 and flanges 108A, 108B are formed atop the halves 112AL and 112AR.

Having illustrated and described the principles of the invention in a preferred embodiment thereof, it should be readily apparent to those skilled in the art that the invention can be modified in arrangement and detail without departing from such principles. All modifications coming within the spirit and scope of the accompanying claims are claimed.

The invention claimed is:

1. A thread storage and dispensing apparatus comprising:

a storage container comprising:

spaced apart side, top and bottom outer walls and a back wall defining a rectilinear container, a handle with a top edge located on the exterior of said top outer wall, horizontal and vertical dividers within said container forming an array of pockets with multiple rows and multiple columns including a top row adjacent to said top outer wall, and said pockets sized to receive spools of thread;

a first array of slots sized for thread to pass through located on said top outer wall, at least one slot located above each of said pockets forming said top row; and a second array of slots sized for thread to pass through located on said top edge of said handle.

2. A thread storage and dispensing apparatus of claim 1 in which the storage container includes at least two layers of said pockets.

3. A thread storage and dispensing apparatus of claim 1 wherein each said first slot located on said top outer wall is rectilinearly shaped with two interior edges spaced apart for thread to pass through, with said slot terminating in an arcuate shape.

4. A thread storage and dispensing apparatus of claim 1 wherein each said second slot located on said handle is v-shaped with two interior edges spaced apart at said top edge of said handle and said interior edges narrowing then forming a circular guide hole.

5. A thread storage and dispensing apparatus of claim 1 further comprising a thread cutter located on said handle.

6. A thread storage and dispensing apparatus of claim 1 further wherein the horizontal dividers below the top row of pockets include a relief in the horizontal divider extending back towards the back wall of the container to allow easy access to the spools of thread stored in a pocket.

7. A thread storage and dispensing apparatus of claim 1 further comprising a base plate temporarily attachable to the exterior of said bottom outer wall for stabilizing said container.

8. A thread storage and dispensing apparatus of claim 7 further comprising reliefs in the horizontal and vertical dividers for storage of said base plate within said container.

9. A thread storage and dispensing apparatus of claim 7 wherein said base plate has top and bottom sides wherein the top side temporarily attaches to the exterior of the bottom outer wall of the storage and dispensing apparatus and the bottom side of the base plate is relieved towards the top side of the base plate forming a pocket in which printed material may be stored.

10. A method for storing and dispensing thread from a container storing multiple spools of thread comprising:

positioning multiple spools of thread adjacent to an outer wall of the container;

passing separate strands of thread from said multiple spools of thread through separate first slots located on the outer wall of said container; and tensioning each separate strand of thread by passing each separate strand of thread through separate second slots spaced from the first slots on the container wherein the container includes a handle and said second slots are located on said handle.

11. A method for storing and dispensing thread from a container storing multiple spools of thread comprising:

positioning multiple spools of thread adjacent to an outer wall of the container;

passing separate strands of thread from said multiple spools of thread through separate first slots located on the outer wall of said container; and tensioning each separate strand of thread by passing each separate strand of thread through separate second slots spaced from the first slots on the container and positioned on an outward extension of the container.

12. A thread storage and dispensing apparatus comprising:

a storage container comprising:

spaced apart side, top and bottom outer walls and a back wall defining a rectilinear container, a handle with a top edge located on the exterior of said top outer wall, horizontal and vertical dividers within said container forming an array of pockets with multiple rows and multiple columns including a top row adjacent to said top outer wall, and said pockets sized to receive spools of thread;

an array of slots sized for thread to pass through located on said top outer wall, at least one slot located above each of said pockets forming said top row;

a base plate with a top and bottom side temporarily attachable to the exterior of said bottom outer wall for stabilizing said container; and reliefs in the horizontal and vertical dividers for storage of said base plate within said container.

13. A thread storage and dispensing apparatus comprising:

a storage container comprising:

spaced apart side, top and bottom outer walls and a back wall defining a rectilinear container, a handle with a top edge located on the exterior of said top outer wall, horizontal and vertical dividers within said container forming an array of pockets with multiple rows and multiple columns including a top row adjacent to said top outer wall, and said pockets sized to receive spools of thread;

an array of slots sized for thread to pass through located on said top outer wall, at least one slot located above each of said pockets forming said top row; and a base plate with a top and bottom side temporarily attachable to the exterior of said bottom outer wall for stabilizing said container, wherein the top side of said base plate temporarily attaches to the exterior of the bottom outer wall of the storage and dispensing apparatus and the bottom side of the base plate is relieved towards the top side of the base plate forming a pocket in which printed material may be stored.

14. A thread storage and dispensing apparatus comprising:

a storage container comprising:

spaced apart side, top and bottom outer walls and a back wall defining a rectilinear container, a handle with a top edge located on the exterior of said top outer wall, horizontal and vertical dividers within said container forming an array of pockets with multiple rows and multiple columns including a top row adjacent to said top outer wall, and said pockets sized to receive spools of thread;

an array of slots sized for thread to pass through located on said top outer wall, at least one slot located above each of said pockets forming said top row; and a base plate with a top and bottom side temporarily attachable to the exterior of said bottom outer wall for stabilizing said container, wherein the base plate has ridges on the top side of the plate and the container has a lid forming a front wall to the layer of pockets wherein the ridges spaced to fit snugly against the closed container when the container sits on the base plate.

15. A thread storage and dispensing apparatus comprising:

a storage container comprising:

spaced apart side, top and bottom outer walls and a back wall defining a rectilinear container, a handle with a top edge located on the exterior of said top outer wall, horizontal and vertical dividers within said container forming an array of pockets with multiple rows and multiple columns including a top row adjacent to said top outer wall, and said pockets sized to receive spools of thread;

an array of slots sized for thread to pass through located on said top outer wall, at least one slot located above each of said pockets forming said top row; and a base plate with a top and bottom side temporarily attachable to the exterior of said bottom outer wall for stabilizing said container, wherein the base plate has ridges on the top side and wherein the horizontal and vertical dividers have reliefs such that the base plate fits within the container with the lid closed, and the dividers and the ridges are mutually spaced to fit the ridges alongside the horizontal dividers.

16. A thread storage and dispensing apparatus of claim 15 wherein the container has a lid forming a front wall to the layer of pockets wherein the ridges of the base plate fit snugly against the closed container when the container sits on the base plate.

* * * * *